US006293989B1

(12) United States Patent
Kim et al.

(10) Patent No.: US 6,293,989 B1
(45) Date of Patent: Sep. 25, 2001

(54) METHOD OF PRODUCING NANOPHASE WC/TIC/CO COMPOSITE POWDER

(75) Inventors: Byoung Kee Kim, Kyungnam; Gook Hyun Ha, Pusan; Dong Won Lee, Kyungnam, all of (KR)

(73) Assignee: Korea Institute of Machinery and Materials (KR)

( * ) Notice: Subject to any disclaimer, the term of this patent is extended or adjusted under 35 U.S.C. 154(b) by 0 days.

(21) Appl. No.: 09/586,544

(22) Filed: May 31, 2000

(30) Foreign Application Priority Data

Jul. 21, 1999 (KR) ..... 99 29436

(51) Int. Cl.[7] ..... B22F 1/00

(52) U.S. Cl. ..... 75/351; 75/355; 75/362; 423/440; 148/237

(58) Field of Search ..... 75/351, 355, 362; 423/440; 148/237

(56) References Cited

U.S. PATENT DOCUMENTS 3,440,035 * 4/1969 Iwase et al. .
5,352,269 * 10/1994 McCandlish et al. ..... 75/351
5,584,907 * 12/1996 Muhammed et al. ..... 75/351
5,632,824 * 5/1997 Grenthe et al. ..... 148/237
5,658,395 * 8/1997 Wahlberg et al. ..... 148/237
5,746,803 * 5/1998 Dunmead et al. ..... 75/351
5,885,653 * 3/1999 Waldenstrom et al. ..... 427/217
5,912,399 * 6/1999 Yu et al. ..... 75/351

* cited by examiner

*Primary Examiner*—Ngoclan Mai
(74) *Attorney, Agent, or Firm*—Howell & Haferkamp LC

(57) ABSTRACT

The present invention relates to a method of producing nanophase WC/TiC/Co composite powder by means of a mechano-chemical process comprising a combination of mechanical and chemical methods. For this purpose, the present invention provides a method of producing nanophase WC/TiC/Co composite powder, said method comprising as follows: a process of producing an initial powder by means of spray-drying from water-soluble salts containing W, Ti, and Co; a process of heating to remove the salts and moisture contained in the initial powder after spray-drying; a process of mechanically ball-milling to grind oxide powder after removing the salts and moisture therefrom, and to homogeneously mix the powder with an addition of carbon; and a process of heating the powder after milling, for reduction and carburization, in an atmosphere of reductive gas or non-oxidative gas.

2 Claims, 5 Drawing Sheets

METHOD OF PRODUCING NANOPHASE WC/TIC/CO COMPOSITE POWDER

TECHNICAL FIELD

The present invention relates to a method of producing nanophase WC/TiC/Co composite powder by means of a mechano-chemical process comprising a combination of mechanical and chemical methods.

BACKGROUND OF THE INVENTION

Since WC/Co-based hard metals have superior characteristics with respect to wear-resistance, high-temperature strength, elastic modules, etc., they are widely used as materials for wear-resistant components, such as non-cutting tools, die materials, etc. On the other hand, since TiC possesses superior physical and mechanical characteristics as compared to WC, the addition of titanium carbide (TiC) leads to improvement of physical and mechanical characteristics of WC/Co alloys, such as:

(1) casing adhesive wear due to its superior thermal conductivity of TiC, which is one of the main requirements for tool materials, (2) improving the mechanic characteristics of a composite, (3) TiC inhibits the growth of WC crystals so that the addition of TiC leads to an increase in thermal stability of alloys, and (4) it facilitates weight reduction.

Currently, WC/TiC/Co hard metals are used as tool materials, and depending on the use thereof, a wide range of the TiC contents is applicable to the extent of tens of weight percentages. At the same time, Co, which is a sintering binder, is added thereto at approximately 5–15 wt %. At the time of fixation of the composition, the important factors affecting the mechanical characteristics of hard metals are the size of carbide particles, the degree of homogeneity of the structure, and the purity of initial powder. Namely, these factors should be taken into consideration.

Generally, due to the fact that the melting point of carbide (main component in hard metals) is extremely high, the only way to produce industrial goods from hard metals is by using powder metallurgy methods such as processes of compacting and sintering.

The traditional production processes for powders are rather sophisticated and have some considerable defects. The method of producing carbide powder is based on the process of reducing and carbonizing $WO_3$ and $TiO_2$, extracted from the ores. As for the WC powder, it is prepared by adding carbon black to the reduced W powder and ball-milling the same for an extended period of time, followed by a process of reduction and carburization in a hydrogen atmosphere at approximately 1,400–1,500° C. However, because of the thermodynamically stable nature of $TiO_2$, tens of hours are onerously required at the more high reaction temperature for reduction and carburization(above 2000° C.). Even after the synthesis of TiC powder, the problem still remains due to the fact that the crystals therein tend to grow extensively during carburization to the size of single-digit microns to tens of microns.

Further, since the temperatures required for carburization are as high as 1400° C., the costs of such method are quite high as they require high-temperature facilities and high energy consumption. The process of re-milling of synthesized coarse WC, TiC powder has been developed for reducing the particle size. There is a limitation of this method for preparing fine particles. Also there is a problem of impurity adulteration with increasing of the milling time. Moreover, it is virtually impossible to mix completely W, Ti with carbon or WC, TiC with Co owing to the differences in their specific gravities.

Furthermore, only the mechanical grinding process controls the particle size of the powder produced by the conventional processes. Consequently, there is a limitation in particle size reducing to fine particles. Although the main factors affecting the mechanical characteristics of hard metals are not only fineness of particles but also the degree of their homogeneity, there remains the disadvantage of failing to accomplish such homogeneous mixing due to the fact that the end-product powder is mechanically admixed therein. Also there are disadvantages caused by a high reaction temperature (ordinarily exceeding 1,400° C.) and long reaction time.

SUMMARY OF THE INVENTION

The present invention is intended to solve the aforementioned problems of the conventional processes by providing a method of producing nanophase WC/TiC/Co composite powder comprising homogeneous distribution of fine carbides of proximately 200 nm or less.

Another objective of the present invention is to provide a simple method of producing nanophase WC/TiC/Co composite powder at a low reaction temperature. To achieve the aforementioned objectives, the method comprises the following steps:

1) Spray-drying of the water solution of salts containing W, Ti, and Co for producing initial powder;

2) Preliminary heat treatment of the initial powder to remove the hygroscopic components and moisture contained in the initial powder after spray-drying;

3) Ball-milling in order to grind the oxide powder and mix it homogeneously with an addition of carbon; and 4) Heating the powder after milling in an atmosphere of reductive or non-oxidative gas for reduction and carburization.

In step (1), a homogeneous initial powder of a fine particle size can be obtained by spray-drying the water-soluble solution (unlike the conventional processes). When the particle size is reduced as above, the surface area for the reaction increases, with the result of enhanced reactivity. In conjunction, the area of contact with the carburization agent (carbon) and the reductive gas also increases, thereby facilitating the reactions of reduction and carburization. Further, because of the initial addition of Co in solution, Co co-exits in the initial powder. As such, the catalytic effects of Co and the distribution of Co in binder-phase become uniform, which in turn enhances the characteristics of the end-product alloy.

Then, the desalting process is carried out with the initial powder produced in step (1), yielding a powder of aggregated oxides without salts and moisture.

The particles of oxide powder should be homogeneously mixed with carbon particles for further facilitating the carburization and reduction reactions. The initial powder and carbon particles are homogeneously mixed during ball-milling by means of a process of grinding and mixing.

The oxide and carbide particles, which are ground to finer particles, should be homogeneously mixed. Then, oxide particles are processed by ball-milling of step (3).

In step (4), the carbon particles mixed in step (3) react with the oxides, and at that time, reduction and carburization take place simultaneously. Consequently, these reactions do not require an extended period of time, and unlike conventional processes, step (4) does not cause coarsening of particles during carburization and yields powder of finer particles. Further, high temperature is not required as in the conventional methods (e.g., 1,400° C. to 1,500° C. required to obtain WC), and the particles can be reduced at a lower temperature. Here, due to the homogeneous particle distribution and finer particle size, the surface area for the reaction increases. As such, it increases the area of contact with the reductive gas and the carburizing agent (carbon), thereby facilitating the reactions of reduction and carburization. In conjunction, the lower temperature is also attributable the catalytic effects of Co co-existing in the initial powder.

BRIEF DESCRIPTION OF THE DRAWINGS

FIG. 2*a* is of the powder after spray-drying; FIG. 2*b* is of the desalted powder; FIG. 2*c* is of the powder after mixing and ball-milling the desalted powder and carbon; and FIG. 2*d* is of the nanophase WC/TiC/Co composite powder obtained after the heating process.

DETAILED DESCRIPTION OF THE PREFERRED EMBODIMENT

Figure 1:
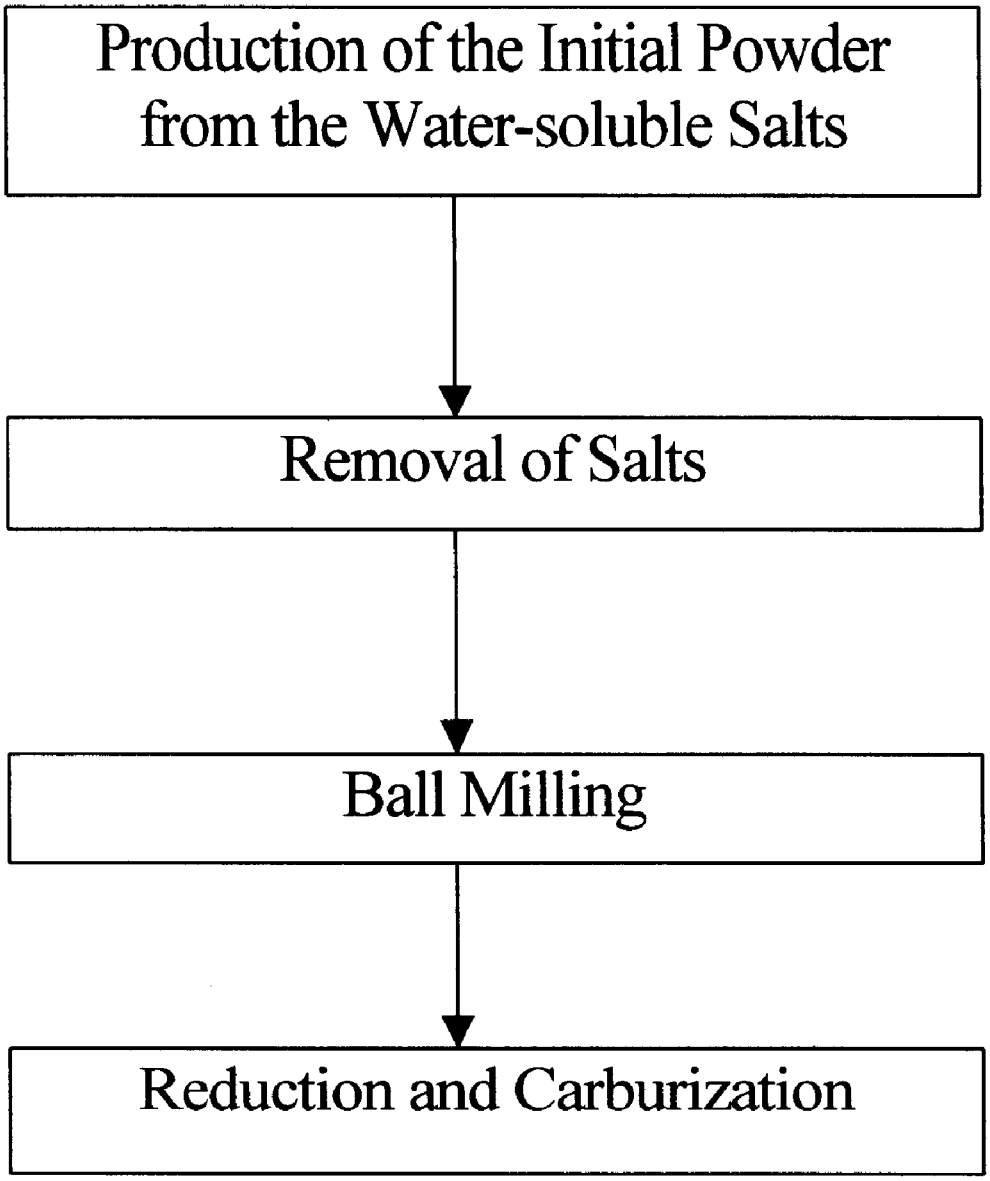
FIG. 1 is a process chart for producing nanophase WC/TiC/Co composite powder.

The method for producing nanophase WC/TiC/Co composite powder by means of a mechano-chemical method (MCP) of the present invention is described in further detail as follows:

FIG. 1 shows the general sequence of the process. Further description of the process is presented according to this chart.

Process of Producing Initial Powder

In this process, water-soluble salts containing W, Ti, and Co were weighed appropriately for the target composition of WC/TiC/Co, after which they were dissolved in water to yield an aqueous solution. The solution was then spray-dried to produce the initial powder. For the water-soluble salts, ammoniummeta-tungstate (AMT, $(NH_4)_6(H_2W_{12}O_{40})_4H_2O)$), Ti-trichloride($TiCl_3$), and Co-nitrate ($Co(NO_3)_{26}H_2O$) were used.

Figure 2A:
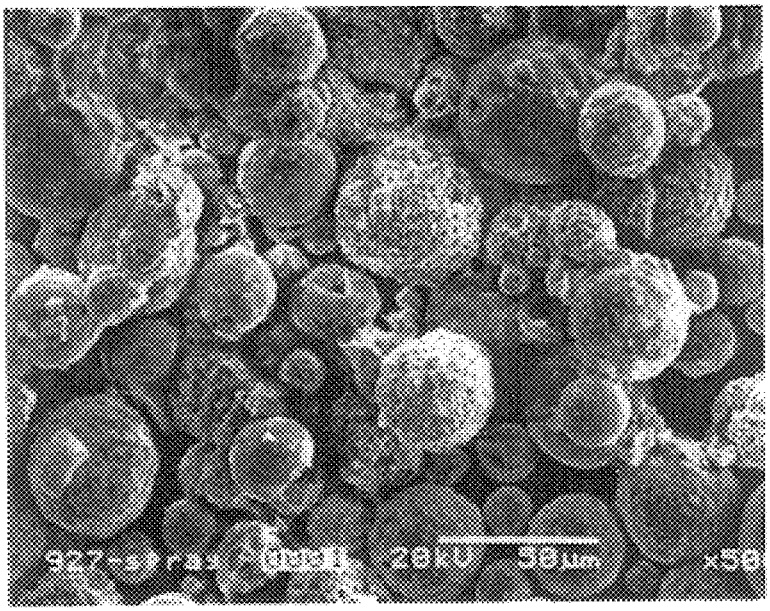
FIGS. 2*a*–2*d* is of the electromicrographs of the powder as produced per respective processes.

The conditions of spraying were set as follows: the intake air at the temperature of 240–260° C., exhaust air at 100–130° C., the nozzle rotation speed of 8,000–14,000 rpm, and the solution feed at 30–100 ml/min. Electromicrographs of the initial powder and the results of its X-ray diffraction analysis are shown respectively in FIG. 2*a* and 2*a* of FIG. 3. The initial powder produced by means of spray-drying turned out to be spherical amorphous particles comprising a homogeneous mixture of ultra fine particles (in terms of molecular size) of W, Ti, Co, other salts, and moisture. There, the size distribution was shown to be in the range of 20 to 50 microns ($\mu$m).

Process of Removing Salt

At this stage, it was necessary to decompose the initial mixture of salts to corresponding oxides. For this purpose, the initial powder after spray-drying was heat-treated in air for two hours. The temperature of such heat treatment should not be less than 200° C. During this procedure, moisture and volatile components were removed from the initial particles. After the heat-treatment, the weight lose of the powder was about 30%.

Figure 2B:
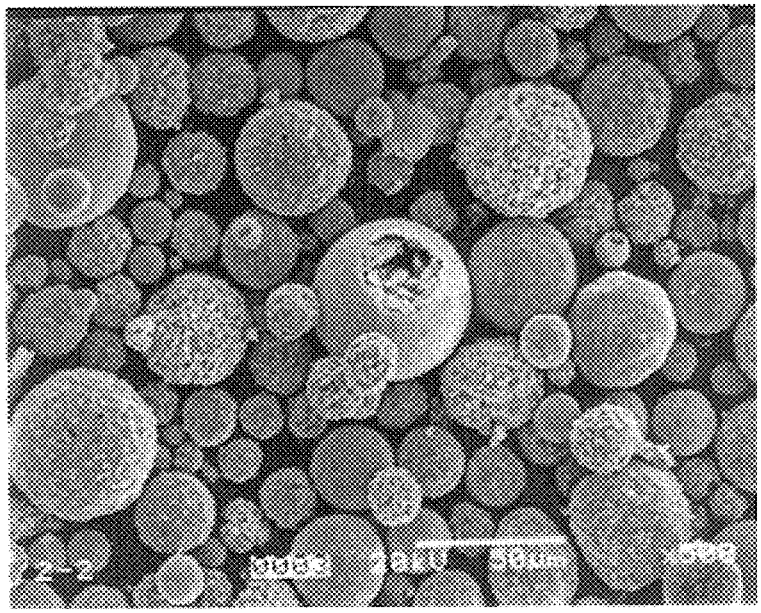

As shown in FIG. 2*b*, the process did not bring about significant changes in morphology and particle size. The results of the X-ray diffraction analysis (3*b* of FIG. 3*b*) showed that the present powder was a mixture of oxides of tungsten ($WO_3$), titanium ($TiO_2$), and cobalt ($Co_3O_4$). Hence, it was clear that the particles were formed after the heat-treatment as homogeneous aggregates of metal oxides.

Process of Ball-milling

Figure 2C:
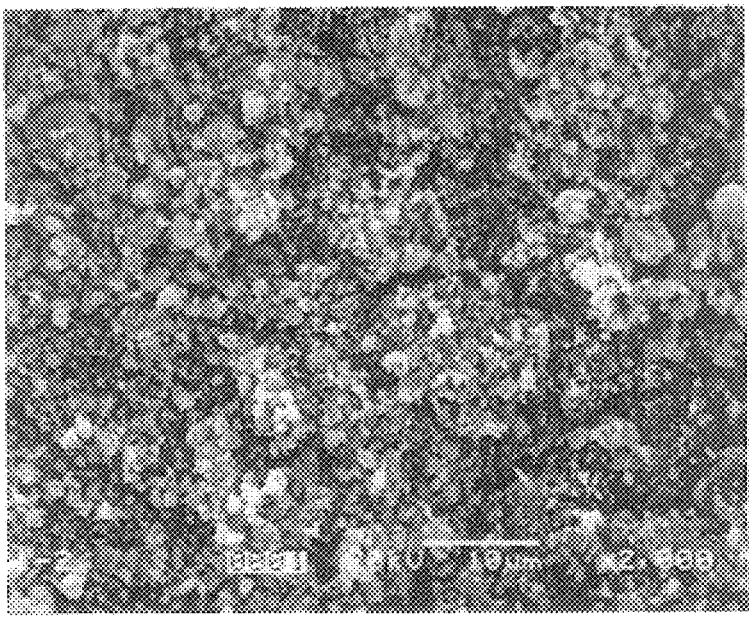
Figure 3:
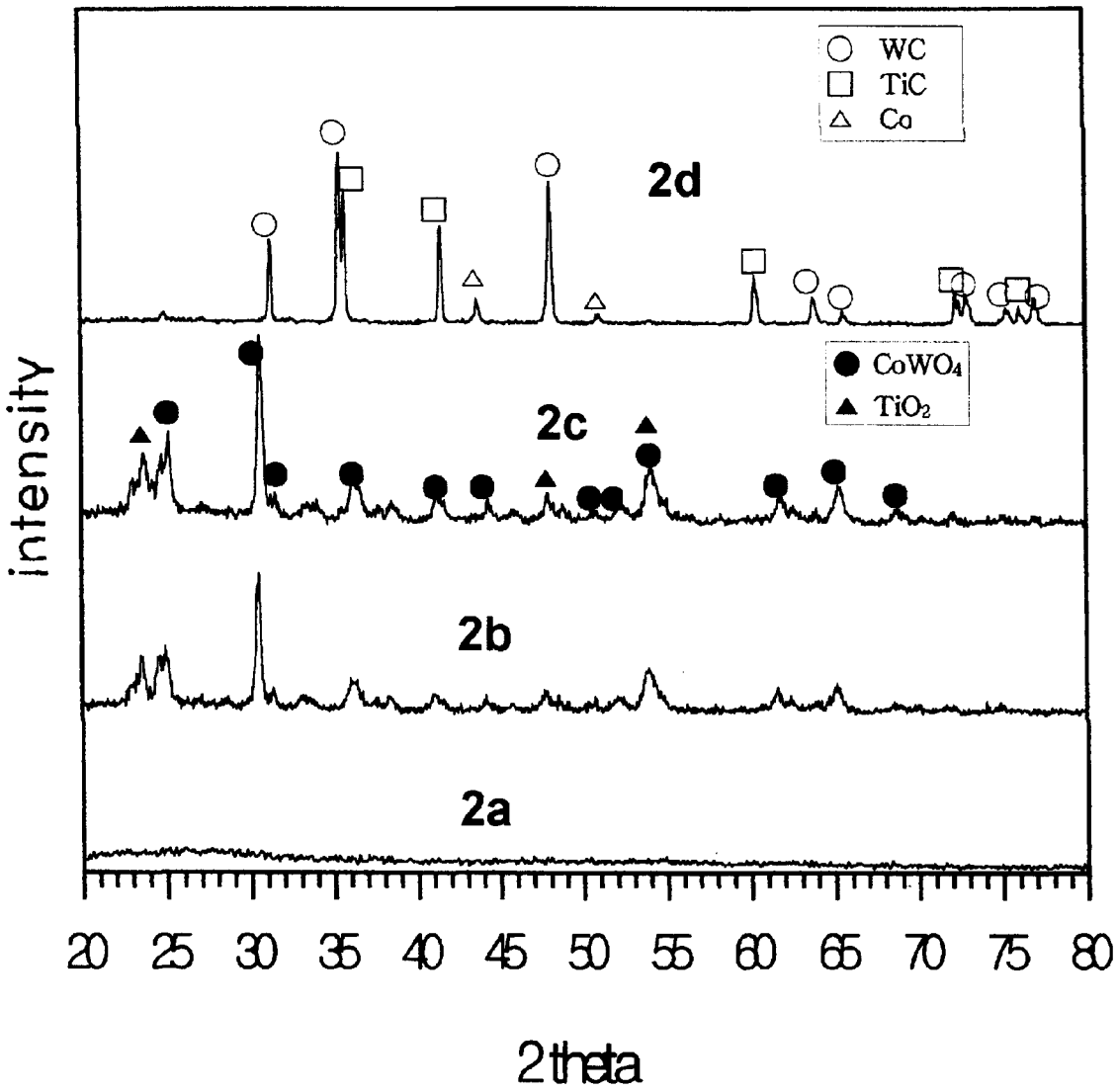
FIG. 3 is the results of the X-ray diffraction analysis of respective powders of FIGS. 2*a*–2*d*.

Oxide aggregates were mechanically mixed with carbon black by the dry-milling procedure. The procedure was carried out in a rotary ball mill for 24 hours in air. The electromicroscopy and the results of the X-ray diffraction analysis of the powder after ball-milling are shown in FIGS. 2*c* and 3*c* of FIG. 3 correspondingly. As a result of this step, the oxide particles were ground to ultra fine size without any phase change and mixed with carbon, which were penetrated into the pores of the oxide powder.

Process of Reduction and Carburization

Figure 4:
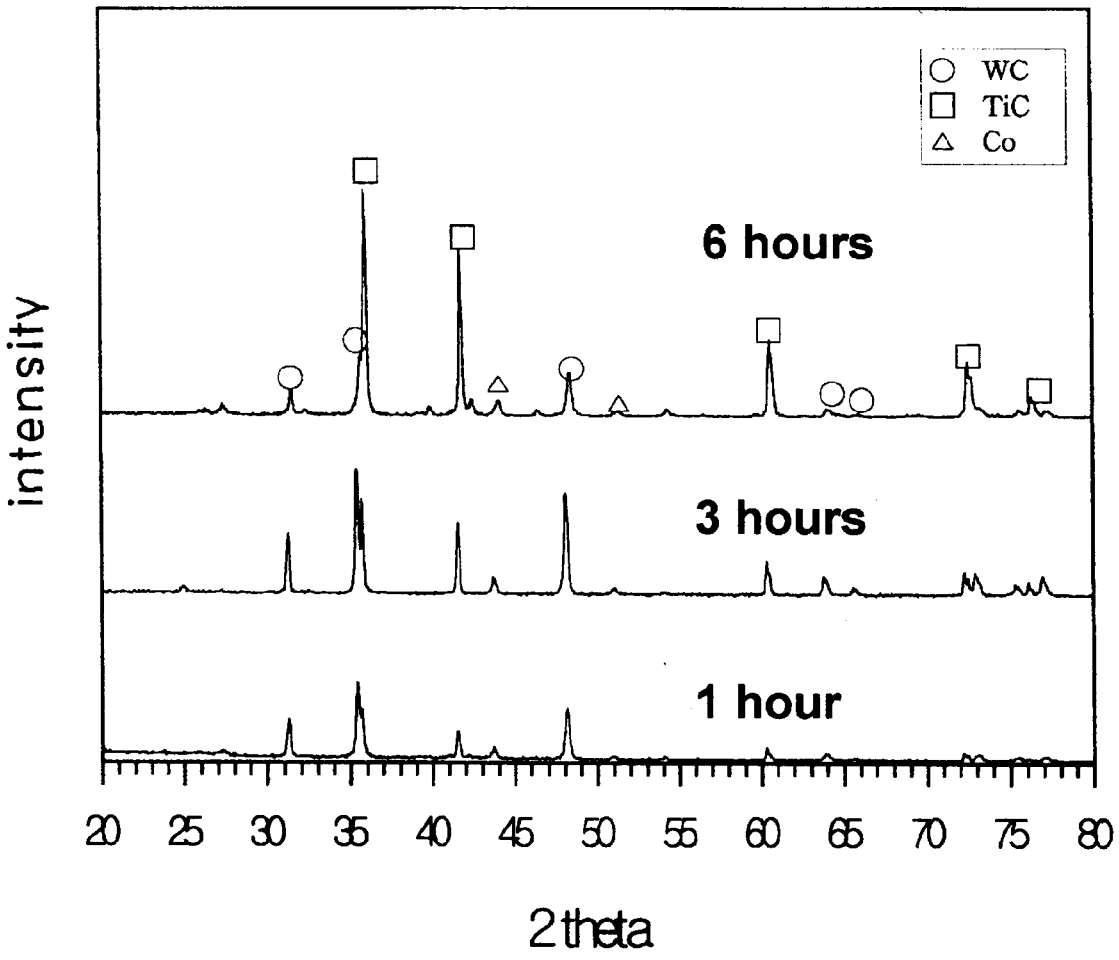
FIG. 4 is the results of the X-ray diffraction analysis of respective powder products according to the changes in the reaction time.

According to the present invention, the process of reduction and carburization is the final stage in WC/TiC/Co powder preparing. The oxides and carbon mixture after ball-milling should be heat-treated for reduction and carburization by carbon. The mixture of oxides and carbon black prepared by ball-milling was heated to the temperature of 1000° C. or more in the reductive atmosphere of $H_2$ or CO, or in the Ar atmosphere for 1–6 hours. The kinetics of the synthesis depended on several factors, such as types of reaction gas, the amount of carbon black added at the time of milling, the amount of powder, time and temperature of the reaction. The changes in phase composition versus the time of heat treatment (1, 3 and 6 hours) are presented in FIG. 4, respectively. It could be shown that the WC phase tended to vanish with increasing of reaction time. This was due to the fact that W was soluted into Co after decarburization of WC by excessive reaction therein.

Preferable time and temperature of the process were 1000° C. and 3 hours, respectively. Here, the heating or cooling rate during the heat treatment was about 10° C./min, and the gas flow was maintained at 200 cc/min. As such, the final product of WC/TiC/Co composite powder was obtained. The process of reduction of oxide particles was carried on together with the process of carburization.

Figure 2D:
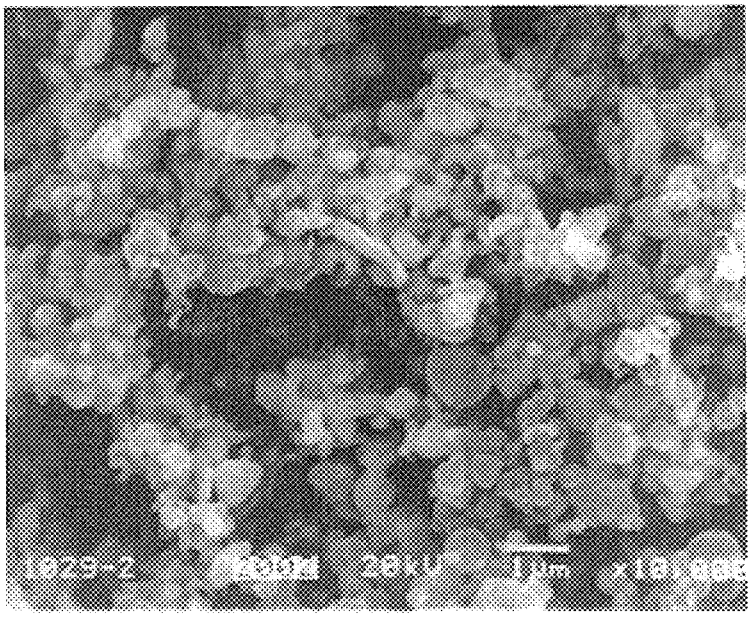

FIG. 2*d* and d of FIG. 3, respectively, show the electron micrographs and results of the X-ray diffraction analysis of the well-synthesized representatives of the WC/TiC/Co composite powder. There, the average size of the carbide was approximately 200 nm. WC (major phase), TiC and Co were shown to be well synthesized.

According to the mechano-chemical method for producing nanophase WC/TiC/Co composite powder under the present invention, as shown above, it has the effects of simplifying the production process as follows: (i) it is possible to obtain composite powder of approximately 200 nm, (ii) the reaction takes place at a relatively lower temperature, unlike the conventional methods requiring higher temperature, and (iii) carburization and reduction take place simultaneously.

What is claimed is:

1. A method of producing nanophase WC/TiC/Co composite powder, comprising:

(i) preparing initial powder by means of spray-drying from water-soluble salts containing W, Ti, and Co;

(ii) heating the initial powder to remove salts and moisture contained therein after spray-drying to thereby produce an oxide powder;

(iii) mechanically ball-milling the oxide powder to grind the oxide powder and to homogeneously mix said oxide powder with an addition of carbon thereto; and, (iv) heating said mixture of oxide powder and carbon, for reduction and carburization, in an atmosphere of reductive gas or non-oxidative gas.

2. A method of producing nanophase WC/TiC/Co composite powder according to claim 1, wherein said water-soluble salts are ammonium meta-tungstate as in $(NH_4)_6(H_2W_{12}O_{40})_4H_2O$, Ti-trichloride as in $TiCl_3$, and Co-nitrate as in $Co(NO_3)_{26}H_2O$.

* * * * *